US007095325B2

(12) United States Patent
McDonald et al.

(10) Patent No.: US 7,095,325 B2
(45) Date of Patent: Aug. 22, 2006

(54) ASSET RECOVERY DEVICE

(75) Inventors: Wesley McDonald, North Vancouver (CA); James Thomas Bowen, Calgary (CA)

(73) Assignee: FastBack Solutions, Inc., Calgary (CA)

( * ) Notice: Subject to any disclaimer, the term of this patent is extended or adjusted under 35 U.S.C. 154(b) by 434 days.

(21) Appl. No.: 10/684,304

(22) Filed: Oct. 11, 2003

(65) Prior Publication Data

US 2004/0130448 A1 Jul. 8, 2004

(51) Int. Cl.
*G08B 13/14* (2006.01)

(52) U.S. Cl. ..... 340/572.1; 340/572.4; 340/539.22; 340/539.32; 340/568.1

(58) Field of Classification Search ..... 340/572.1, 340/572.4, 539.22, 539.32, 586.1
See application file for complete search history.

(56) References Cited

U.S. PATENT DOCUMENTS 5,677,673 A * 10/1997 Kipnis ..... 340/539.32

6,133,832 A * 10/2000 Winder et al. ..... 340/572.1

* cited by examiner

*Primary Examiner*—Tai T. Nguyen
(74) *Attorney, Agent, or Firm*—Macheledt Bales & Heidmiller LLP

(57) ABSTRACT

A system is presented for a novel apparatus and method that shortens the time that an asset is lost and increases the probability of return should the asset go astray. The system is intended to allow the asset to proactively alert passers-by that it is lost and also alert the owner of the asset that the asset is lost. The invention contains identification and contact information to aid in the safe, prompt return of the asset. The system comprises an asset tag that is attached to the asset and a base station that is 'synchronized' with a the asset tag at specified intervals. Should the asset tag not synchronize with the base station within a predetermined interval, it will emit a personalized voice recording to let passers-by know that the asset is lost and in need of safe return to it's owner. In addition, the system can alert the owner that the asset has gone missing. In this case, the base station may emit a warning indicating that the asset tag has not synchronized with the base station within the predetermined interval.

21 Claims, 5 Drawing Sheets

ASSET RECOVERY DEVICE

FIELD OF THE INVENTION

The present invention is concerned with a method and system to promote the prompt return of a lost asset. More specifically, the present invention relates to a device that aids in the recovery of lost pets, lost children or lost personal items as but a few examples of the application of the present invention.

BACKGROUND OF THE INVENTION

Statistics show that the majority of lost pets or children are not recovered by police, veterinarians, animal shelters, or humane societies, but rather by the owner's friends or neighbors. This also applies to lost inanimate objects. It stands to reason then that, the faster the asset is found, the sooner it can be returned to its owner.

There is a need, not satisfied by the prior art, for a system that uses "speech" emitted from the asset itself to alert the public that it is lost. For example, a person is more likely to go to the assistance of a crying child than to one that is quietly walking down the sidewalk. It is desirable to shorten the time that an asset is lost and enhance its probability of being found and returned. It is also desirable to give the asset the power of self-notification and to draw upon the innate human desire to assist those demonstrating distress. The present invention addresses the shortcomings in the prior art to aid in the recovery of lost assets.

SUMMARY

This invention relates to a system that emits and receives a signal that serves to activate alarm mechanisms to alert both the owner of a lost asset and the public at large that the asset is astray and may be in need of assistance. The system fulfills the unmet need for proactive loss notification through a unique combination of RF transceivers and voice record/playback technologies.

These assets may include lost pets, young children, suitcases, and any other personal items. The invention makes use of electronic components such as wireless radio frequency transceivers and voice recording/playback chips to notify the general public at large that an asset is lost and to notify the owner of asset that the asset is lost.

The system of the present invention comprises two basic components: an asset tag that attaches to the asset and a base station that it is positioned near the asset owner. The asset tag consists of a wireless radio frequency transceiver, an antenna, a voice recording and playback circuit with speaker, a logic control circuit or controller to control the transceiver and voice recording/playback circuit, a battery-based power supply, a power indicator, control buttons to control the functions of the logic controller and the voice recording/playback circuit and a weather resistant housing to protect the electronics contained therein. The asset tag is designed to be small, lightweight and easy to attach to the asset.

The base station consists of a wireless radio frequency transceiver complementary to the transceiver in the asset tag, an antenna, an alarm playback circuit, a logic control circuit or controller to control the transceiver and the alarm playback circuit, a power supply that may use either batteries or an external battery eliminator such as an AC/DC power adapter, control buttons to control the functions of the logic controller and the alarm playback circuit and a weather resistant housing to protect the electronics contained therein. The housing may be designed to be a desk-top box or a small, ergonomically designed enclosure similar to a cell-phone or walkie-talkie that can be easily carried in a pocket, a purse or clipped onto a belt.

The transceiver circuits are readily available radio frequency transceiver integrated circuit devices that are commonly used in wireless pagers, cell-phones or family radio service walkie-talkies and are well known to those skilled in the art. Conceivably, wireless radio frequency transceivers used in global positioning systems ("GPS") devices could be used as well.

The logic controllers are, preferably, microprocessors or micro-controllers having the capability to contain a software program to control the operation of the asset tag and base station electronics, as the case may be. The asset tag and base station will have their logic controllers programmed with an identification code that is unique to a specific asset tag. Alternatively, the asset tag and base station may have a set of "dip switches" that allows the owner to manually select an identification code for the asset.

The voice recording/playback circuit consists of readily available consumer electronic integrated circuit devices that are well known to those skilled in the art. The circuit allows the owner to record their own personalized message that will be played by the asset tag if the asset becomes lost. Preferably, this circuit will have the capability to record and playback two such personalized alarm messages. The asset tag will preferably have a record button to activate the recording functionality of the asset tag. The first alarm message will simply be an alert message indicating to the public at large that the asset is lost. Preferably, the voice recording/playback circuit will allow up to 20 seconds of recording time for the first alarm message. The second alarm message capability allows the owner to record a more detailed message with information about the asset and how to return the asset to its owner. Preferably, the circuit will allow up to 60 seconds of recording time for the second alarm message.

The second message is played when a person who locates the lost asset presses a playback button on the asset tag. The asset tag itself will preferably have a printed message on the housing directing the person who finds the asset to press the playback button for further information. For example, the first message may simply be, "Help me, I'm lost!" The second message could be, "I belong to Jane Doe. Please call Jane at 555-1234 to return me to Jane". The ability to record personalized messages leaves the content of the messages up to the owner to determine and record.

The alarm playback circuit of the base station may be as simple as a beep or buzzer to alert the owner that the asset is lost. This circuit could also have the capability to record and playback a personalized message indicating that the asset is lost.

The asset tag power supply is preferably battery-based. The asset tag is preferably lightweight and small in size so that it may easily clip onto a pet collar, a piece of luggage or to the clothing of a young child. Preferably, watch or hearing-aid batteries would be used in the asset tag to keep the size and weight of the asset tag to a minimum.

The base station power supply may use either batteries or a battery-eliminator such as an AC/DC adapter that are readily available and well known to those skilled in the art. The base station can be larger in size than the asset tag, similar in size to a family radio service-type walkie-talkie. The base station may be carried by the owner in their pocket or purse or clipped onto their belt.

In operation, the system works by synchronizing the asset tag with the base station. The base station, on a periodic basis, will transmit a radio signal that contains an unique identification code that corresponds to the asset. The base station will transmit the signal in a repetitive fashion, for example, ten times a second.

The asset tag listens for the radio signal from the base station. The asset tag receives the radio signal and compares the identification code in the signal with the unique identification code programmed in the asset tag. To conserve power at the asset tag, the asset tag's transceiver may be controlled by the asset tag's logic controller to turn the transceiver on to listen for the base station radio signal for only a fraction of the time when the base station is transmitting its radio signal. For example, the asset tag will turn the transceiver on for one-tenth of a second every second. If the comparison of the identification codes results in a match, then the asset tag will "check-in" or synchronize with the base station by transmitting a radio frequency signal with the asset tag's unique identification code.

If the asset tag does not receive the radio signal from the base station within a predetermined period of time or if the comparison of the identification codes does not result in a match, then the asset tag will play the first alarm message indicating that the asset is lost. When the first alarm message attracts the attention of a person near the asset, that person may activate the second alarm message by pressing the playback button on the asset tag. The second alarm message will play the additional information recorded by the owner on how to contact the owner or to return the asset to the owner, depending on what the owner recorded as the second alarm message.

The base station receives the synchronization signal from the asset tag and compares the identification code in the asset tag radio signal with the identification code sent by the base station. If the comparison results in a match, the base station repeats the synchronization process cycle. If the base station does not receive the synchronization radio signal from the asset tag within a predetermined period of time, preferably in the range of 10 seconds (if used with a young child) to 15 minutes (if used with a pet in the backyard), or if the comparison of the identification codes does not result in a match, then the base station will activate its alarm circuit to alert the owner that the asset has moved out of the synchronization range. The base alarm message may be a beeper or buzzer. Alternatively, the base station may include its own voice message recording and playback mechanism to permit the owner to record a personalized alarm message to indicate that the asset is out of "sync range".

The purpose of the system is to inform the owner of the asset when the asset is no longer within a predetermined proximity or distance from the base station. The distance or threshold in which alarms are generated is determined by the frequency and signal strength of the radio frequency signal transmitted by the transceiver circuits in both the asset tag and the base station. The alarm threshold distance will be the distance between the asset tag and the base station in which the signal strength becomes weak enough so as to not be detected by the transceiver circuit. The threshold distance is selectable and is preferably adjustable from as little as 2 meters (for use with a young child) to as much as 200 meters or more (for use with a pet in the backyard). The threshold or "sync range" is a function of the frequency of the radio signal, the antennas used on both the asset tag and base station and the power strength of the radio signal itself.

The system was originally conceived to have one base station and one asset tag thereby requiring a unique base station for each unique asset tag. However, another embodiment of the present invention has a system with one base station that can work with a number of different and unique asset tags and, therefore, monitor a number of assets by transmitting and receiving a number of unique predetermined identification signals on a cyclic basis to keep track of a number of unique assets.

Broadly stated, one aspect of the present invention is a method for identifying a lost asset, the method comprising the steps of periodically transmitting a first predetermined identification signal from a base station, the first predetermined identification signal unique to the asset, each transmission of the first predetermined identification signal separated by a first predetermined period of time, receiving the first predetermined identification signal at an asset tag attached to the asset, the asset tag having a predetermined identification code unique to the asset, comparing the first predetermined identification signal with the predetermined identification code of the asset at the asset tag, synchronizing the asset tag to the base station by transmitting a second predetermined identification signal from the asset tag if the first predetermined identification signal matches the predetermined identification code of the asset, the second predetermined identification signal containing the predetermined identification code of the asset, generating a first alarm message at the asset tag indicating that the asset is lost if the first predetermined identification signal does not match the predetermined identification code of the asset or if the first predetermined identification signal is not received after a first predetermined period of time, receiving the second predetermined identification signal at the base station, comparing the second predetermined identification signal with the first predetermined identification signal at the base station, and generating a base alarm message at the base station indicating that the asset is lost if the predetermined identification code of the asset contained in the second predetermined identification signal does not match the first predetermined identification signal or if the second predetermined identification signal is not received after a second predetermined period of time.

Broadly stated, another aspect of the present invention is a system for identifying a lost asset, comprising means for transmitting a predetermined identification signal from a base station, the first predetermined identification signal unique to the asset, means for receiving the first predetermined identification signal at a asset tag attached to the asset, the asset tag having a predetermined identification code unique to the asset, means for comparing the first predetermined identification signal with the predetermined identification code of the asset, means for synchronizing the asset tag to the base station by transmitting a second predetermined identification signal from the asset tag if the first predetermined identification signal matches the predetermined identification code of the asset, the second predetermined identification signal containing the predetermined identification code of the asset, means for generating a first alarm message at the asset tag indicating that the asset is lost if the first predetermined identification signal does not match the predetermined identification code of the asset or if the first predetermined identification signal is not received after a first predetermined period of time, means for receiving the second predetermined identification signal at the base station, means for comparing the second predetermined identification signal with the first predetermined identification signal at the base station, and means for generating a base alarm message at the base station indicating that the asset is lost if the predetermined identification code of the asset contained in the second predetermined identification signal does not match the first predetermined identification signal or if the second predetermined identification signal is not received after a second predetermined period of time.

Broadly stated, another aspect of the present invention is A system for identifying a lost asset, comprising a base station having means for assigning a predetermined identification code unique to the asset, a first wireless radio frequency signal transceiver operatively connected to a base station antenna, a first microprocessor operating a first software program operatively connected to the first wireless radio frequency signal transceiver and the means for assigning the predetermined identification code unique to the asset, a base alarm message playback mechanism operatively connected to the first microprocessor, a power supply operatively connected to the first transceiver, the first microprocessor and the base alarm message playback mechanism, a suitable enclosure for housing the elements of the base station listed above whereby the base station is capable of transmitting a first predetermined identification signal unique to the asset, receiving a second predetermined identification signal containing a predetermined identification code of an asset, comparing the first predetermined identification signal with the predetermined identification code contained in the second predetermined identification signal and generating a base alarm message if said predetermined identification code does not match the first predetermined identification signal or if the second predetermined identification signal is not received within a first predetermined period of time; and an asset tag having means for assigning a predetermined identification code unique to the asset tag, a second wireless radio frequency signal transceiver operatively connected to an asset tag antenna, a second microprocessor operating a second software program operatively connected to the second wireless radio frequency signal transceiver and the means for assigning the predetermined identification code of the asset tag, an asset tag alarm message recording and playback mechanism operatively connected to the second microprocessor, the alarm recording and playback mechanism adapted to record and playback a first alarm message, a power supply operatively connected to the second transceiver, the second microprocessor and the alarm message recording and playback mechanism, a suitable enclosure for housing the elements of the asset tag listed above and attaching to an asset whereby the asset tag is capable of receiving the first predetermined identification signal, comparing the first predetermined identification signal with the predetermined identification code of the asset tag, synchronizing with the base station by transmitting the second predetermined identification signal containing the predetermined identification code of the asset tag if the first predetermined identification signal matches the predetermined identification code of the asset tag and generating the first alarm message if the first predetermined identification signal does not match the predetermined identification code of the asset tag or if the first predetermined identification signal is not received within a second predetermined period of time.

DETAILED DESCRIPTION OF THE EMBODIMENTS

Figure 1:
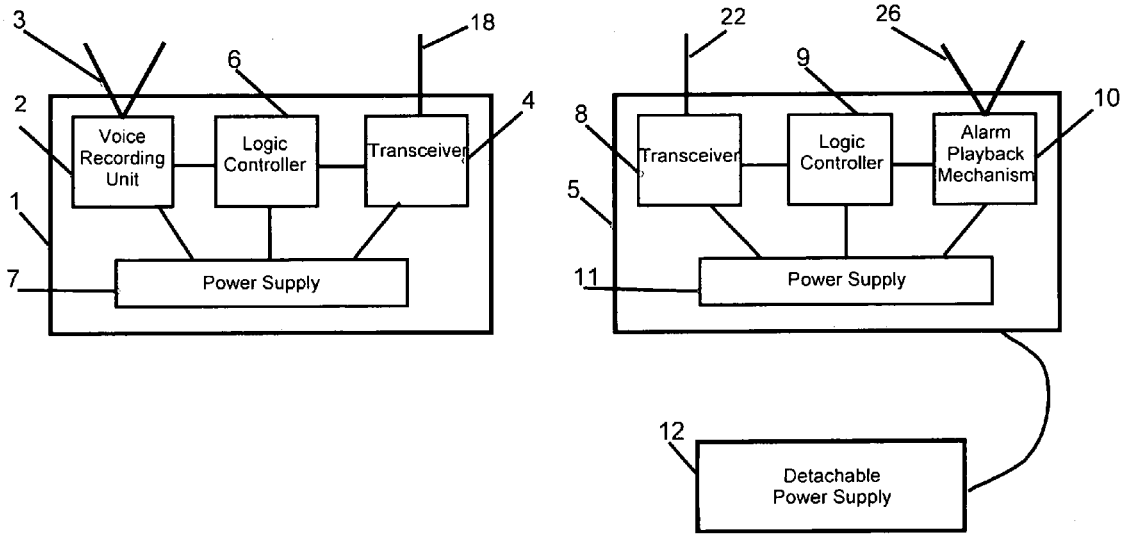
FIG. 1 is a block diagram of the system of the present invention.
Figure 2:
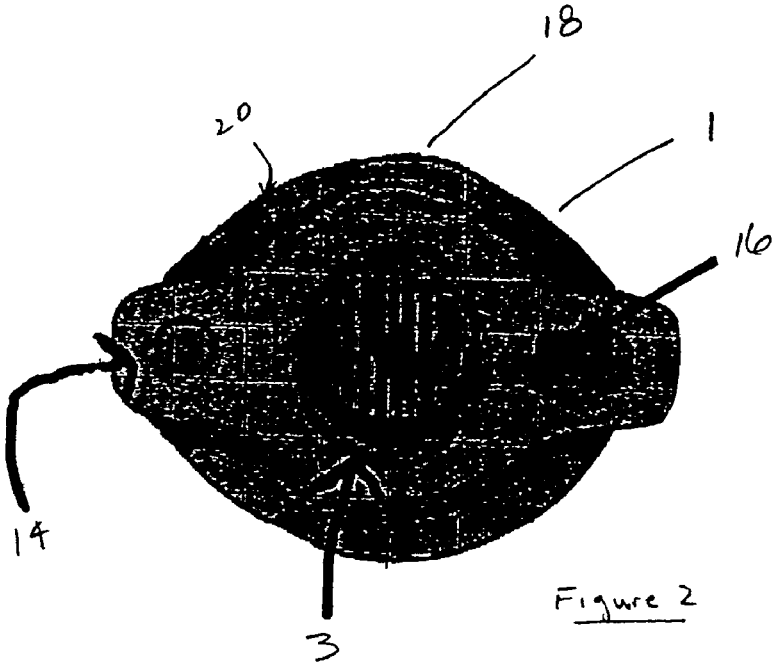
FIG. 2 is an illustration of the asset tag of the system of the present invention.
Figure 3:
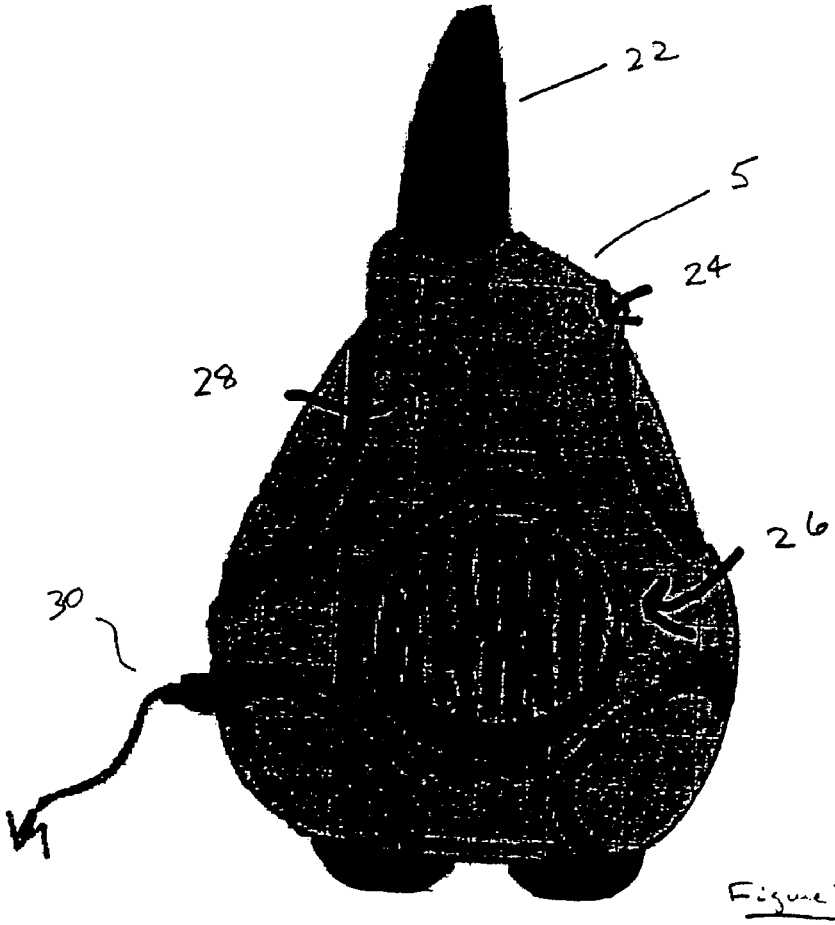
FIG. 3 is an illustration of the base station of the system of the present invention.

Referring to FIGS. 1, 2 and 3, therein illustrated is the system of the present invention, in which the asset tag and a base station communicate through RF transmission to synchronize the asset tag with the base station. When the tag has not been synchronized, it is placed into a mode in which a recorded first alarm message is played from the unit, indicating the asset is lost and needs help. The tag can record and store a personalized message from the asset's owner, which is played when it fails to synchronize. When the asset is located by a person, the asset tag has a printed notice directing the person to press the playback button which causes the asset tag to play a recorded second alarm message which will provide further information about the asset and how to return the asset to its owner.

In a preferred embodiment, asset tag 1 may include (but will not be restricted to contain) a voice-recording circuit 2 with playback capability that, via a speaker 3, will notify the public at large that the asset its attached to is lost; a transceiver 4 that synchronizes and/or otherwise "checks in" with a base station transceiver 8; and a logic controller 6 or similar device or logic that allows for the activation of voice notification should the synchronization not occur within a specified amount of time. In addition, the use of batteries or related power supplies 7 may be used to energize the circuits.

As shown in FIG. 2, asset tag 1 has function button 14 to control the record and playback capabilities of asset tag 1. The first and second alarm messages are played back through speaker 3. Light emitting diode ("LED") 20 indicates that asset tag 1 is powered up. Playback button 16, when pressed, activates the playback of the second alarm message. Antenna 18 receives and transmits the radio synchronization signals between asset tag 1 and base station 5.

In a preferred embodiment, a base station 5 may include (but will not be restricted to contain) a transceiver 8 that synchronizes and/or otherwise "checks in" with the asset tag transceiver 4, and logic controller 9 or similar device or logic that allows for the activation of alarm playback mechanism 10 such as an internal alarm to notify the owner that the asset tag has not "checked in" within a specified period of time.

Alarm playback mechanism 10 is comprised of an integrated circuit (not shown) that generates an alarm beep or tone when asset tag 1 has lost synchronization with base station 5. The integrated circuit is connected to an audio amplifier (not shown) to amplify the alarm beep or tone to be reproduced on speaker 26. In an alternative embodiment, alarm playback mechanism 10 may include an integrated circuit with the capability record, store and playback a voice message as the base alarm message to alert the owner that asset tag 1 has lost synchronization with base station 5.

The use of batteries or related power supplies 11 may be used to power the unit when it is used in a portable manner. As well, a detachable power-supply 12 that can plug the unit into a standard home AC power outlet may be used through power connection 30. LED 24 indicates that base station 5 is powered up.

Figure 4:
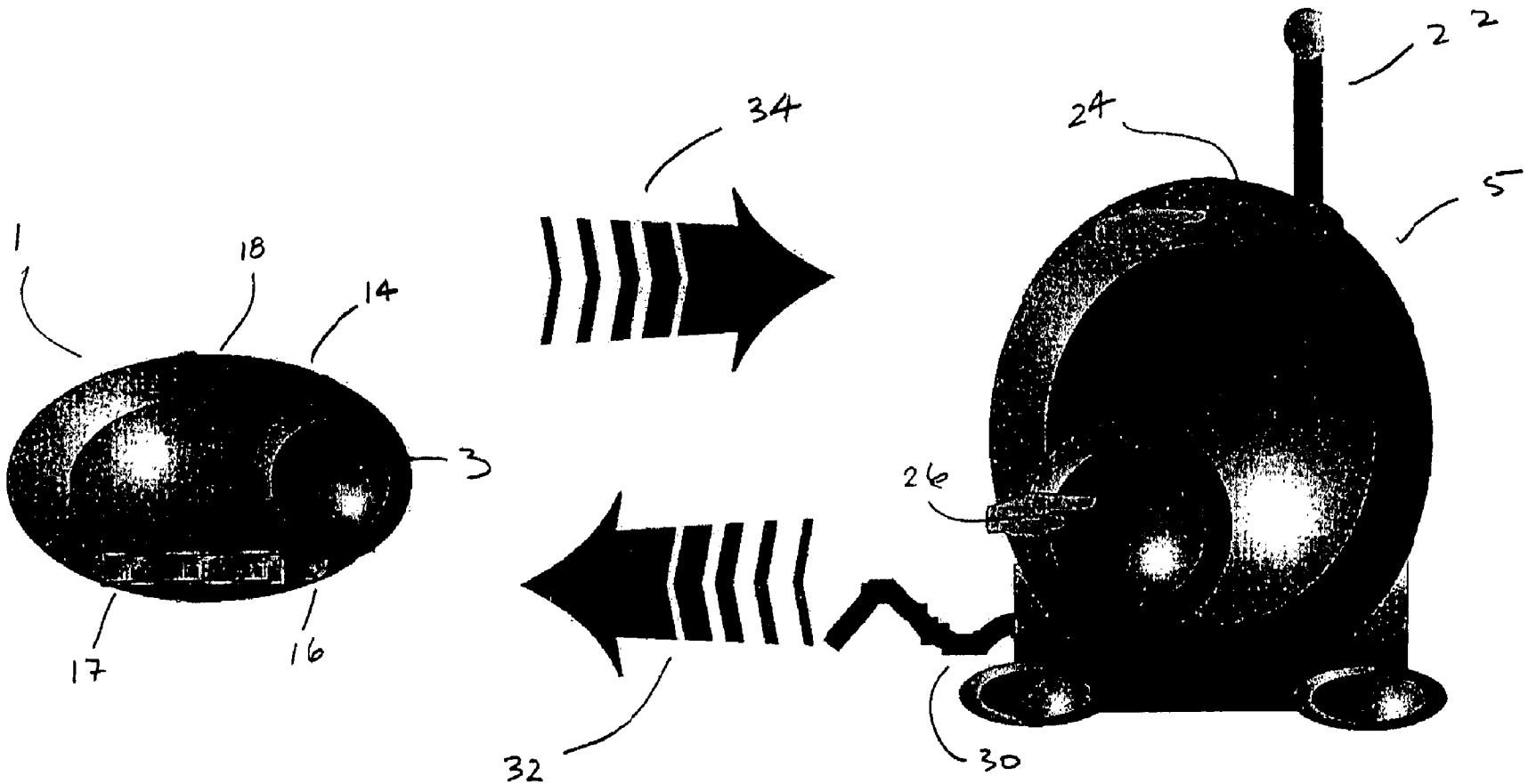
FIG. 4 is an illustration of the synchronization process between the asset tag and the base station of the present invention.

FIG. 4 illustrates the conceptual synchronization process of the present invention. Base station 5 transmits base station signal 32 from antenna 22. Asset tag 1 receives base station signal 32 via antenna 18. Upon receiving base station signal 32, asset tag 1 synchronizes with base station 5 by transmitting asset tag signal 34. When base station 5 receives asset tag signal 34, base station 5 will then cyclically repeat the synchronization process.

If asset tag 1 does not receive base station signal 32, it means that asset tag 1 has moved out of the synchronization range of base station 5. This range is adjustable by varying the signal power of the radio signals used by the system. The range is preferably from 5 meters to 100 meters. If asset tag 1 becomes out of sync with base station 5, it will then play the first alarm message from speaker 3. A passerby, hearing the first alarm message, may investigate the source of the alarm message and locate the asset and asset tag 1. Message 17 printed on asset tag 1 will direct the passerby to press playback button 16 which will cause asset tag 1 to play the second alarm message that contains further information regarding the asset. As the alarm messages are recorded by the owner, the owner can record any pertinent information regarding the asset to effect the return of the asset to the owner. Likewise, if base station 5 stops receiving asset tag signal 34, base station 5 will then play its base alarm message on speaker 26 to alert the owner that the asset is now out of synchronization range with base station 5.

Figure 5:
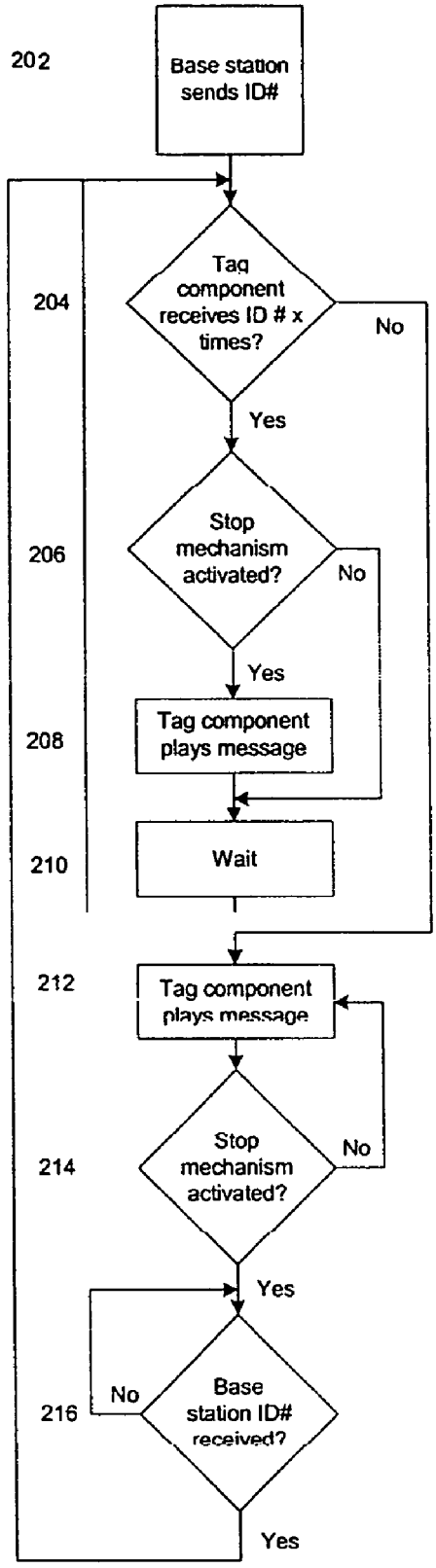
FIG. 5 is a flow chart of the synchronization process followed by the asset tag of the system of the present invention.

FIG. 5 is a flow chart that depicts the system logic in detail for the synchronization of the asset tag 1 and the resultant effect of a loss of synchronization. At step 202, the base station 5 emits an identification number signal (through, for example an RF link) to the asset tag 1. In a preferred embodiment, the base station 5 may send the identification number ten times per second. In a preferred embodiment, the asset tag 1 can listen for the identification number for one-tenth of a second once every second in order to save power.

Step 202 is followed by step 204, in which the asset tag 1 receives the identification number. If the identification number is not received a certain number of times (such as once, twice, etc.), the "NO" branch is followed to step 212 wherein the asset tag 1 will play a pre-recorded voice message. In step 214 if a stopping mechanism (such as a stop button) is not activated the "NO" branch is followed and the voice message repeats continuously. If the stopping mechanism is activated then the "YES" branch is followed to step 216. At step 216, the voice message stops playing and the asset tag 1 listens for the identification number sent by the base station 5. If the identification number is received, the "YES" branch is followed to step 204 where the process starts over. If the identification number is not received, then the "NO" branch is followed and the asset tag 1 waits until it receives the identification number.

Referring back to step 204, if the identification number is received, the "YES" branch is followed to step 206. If the stopping mechanism is activated at step 206 the "YES" branch is followed to step 208 wherein the asset tag 1 will play the pre-recorded voice message once before proceeding to step 210. If the stopping mechanism is not activated at step 206, the "NO" branch proceeds directly to step 210. At step 210, the asset tag 1 waits a predetermined period of time (such as one-half second, one second, etc.), before returning back to step 204.

Figure 6:
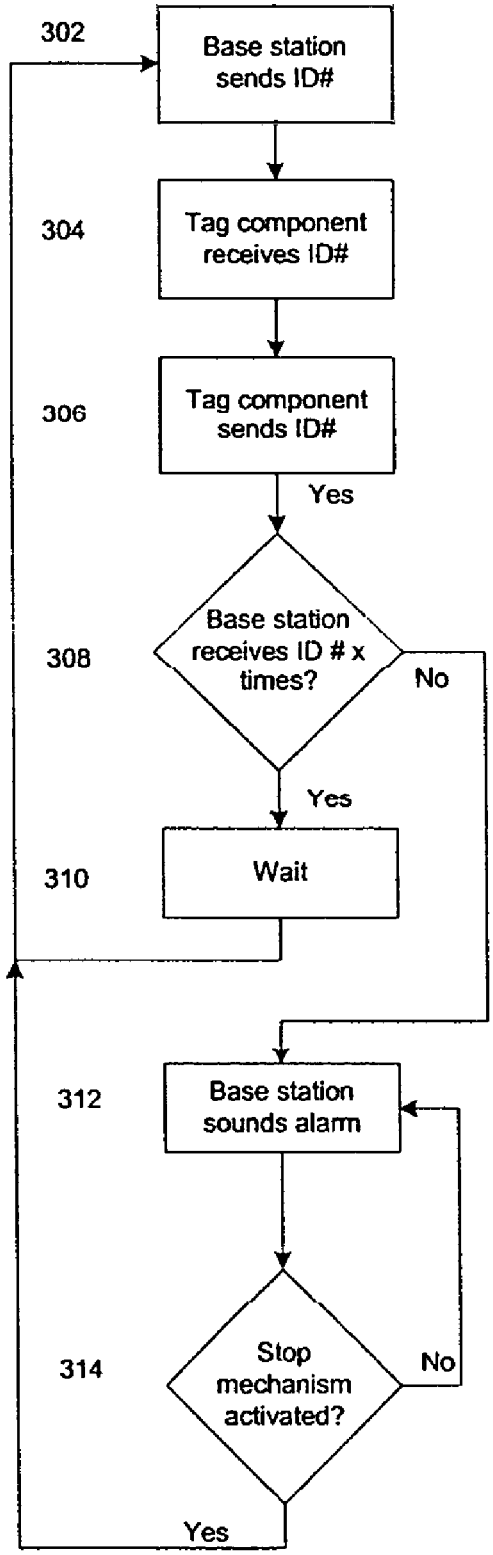
FIG. 6 is a flow chart of the synchronization process followed by the base station of the system of the present invention.

Referring now to FIG. 6, depicted therein is a flow chart of the system logic in detail for the synchronization of the base unit 5 and the resultant effect of a loss of synchronization. In step 302, the base station 5 emits an identification number signal (through, for example, an RF link) to the asset tag 1. In step 304, the asset tag 1 receives the identification number. In step 306, the asset tag 1 sends its own identification number to the base station 5. At step 308, the base station 5 waits to receive the identification number from the asset tag 1. If the base station 5 receives the asset tag's identification number continuously for a predetermined number of seconds (such as one, two, etc.), the "YES" branch is followed to step 310. At step 310, the asset tag 1 waits a predetermined period of time (such as one-half second, one second, etc.), before returning back to step 302.

If the base station 5 does not receive the asset tag's identification number continuously for a predetermined number of seconds, the "NO" branch is followed to step 312 wherein the base station 5 sounds an alarm. If the stopping mechanism in step 314 is activated, the "YES" branch is followed to step 302 and the process starts over again. If the stopping mechanism in step 314 is not activated the "NO" branch is followed and the alarm will ring continuously until the stopping mechanism is activated.

Although a few preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized at the scope of the invention as defined and limited only by the claims that follow.

We claim:

1. A method for identifying a lost asset, the method comprising the steps of:

a) periodically transmitting a first predetermined identification signal from a base station, the first predetermined identification signal unique to the asset, each transmission of the first predetermined identification signal separated by a first predetermined period of time;

b) receiving the first predetermined identification signal at an asset tag attached to the asset, the asset tag having a predetermined identification code unique to the asset;

c) comparing the first predetermined identification signal with the predetermined identification code of the asset at the asset tag;

d) synchronizing the asset tag to the base station by transmitting a second predetermined identification signal from the asset tag if the first predetermined identification signal matches the predetermined identification code of the asset, the second predetermined identification signal containing the predetermined identification code of the asset;

e) generating a first alarm message at the asset tag indicating that the asset is lost if the first predetermined identification signal does not match the predetermined identification code of the asset or if the first predetermined identification signal is not received after a first predetermined period of time;

f) receiving the second predetermined identification signal at the base station;

g) comparing the second predetermined identification signal with the first predetermined identification signal at the base station; and h) generating a base alarm message at the base station indicating that the asset is lost if the predetermined identification code of the asset contained in the second predetermined identification signal does not match the first predetermined identification signal or if the second predetermined identification signal is not received after a second predetermined period of time.

2. The method as set forth in claim 1 further comprising the step of generating a second alarm message at the asset tag after the first alarm message has been generated, the second alarm message being generated when a playback button on the asset tag is manually operated.

3. The method as set forth in claim 1 wherein the first alarm message is a first prerecorded audible voice message stating that the asset is lost.

4. The method as set forth in claim 2 where the second alarm message is a second prerecorded audible voice message containing further information regarding the asset.

5. A system for identifying a lost asset, comprising:

a) means for transmitting a predetermined identification signal from a base station, the first predetermined identification signal unique to the asset;

b) means for receiving the first predetermined identification signal at a asset tag attached to the asset, the asset tag having a predetermined identification code unique to the asset;

c) means for comparing the first predetermined identification signal with the predetermined identification code of the asset;

d) means for synchronizing the asset tag to the base station by transmitting a second predetermined identification signal from the asset tag if the first predetermined identification signal matches the predetermined identification code of the asset, the second predetermined identification signal containing the predetermined identification code of the asset;

e) means for generating a first alarm message at the asset tag indicating that the asset is lost if the first predetermined identification signal does not match the predetermined identification code of the asset or if the first predetermined identification signal is not received after a first predetermined period of time;

f) means for receiving the second predetermined identification signal at the base station;

g) means for comparing the second predetermined identification signal with the first predetermined identification signal at the base station; and h) means for generating a base alarm message at the base station indicating that the asset is lost if the predetermined identification code of the asset contained in the second predetermined identification signal does not match the first predetermined identification signal or if the second predetermined identification signal is not received after a second predetermined period of time.

6. The system as set forth in claim 5 wherein the means for transmitting the first predetermined identification signal and the means for receiving the second predetermined identification signal are combined into a first radio frequency transceiver circuit operatively connected to a base station antenna, the first radio transceiver and first antenna located at the base station.

7. The system as set forth in claim 5 wherein the means for receiving the first predetermined identification signal and the means for transmitting the second predetermined identification signal are combined into a second radio frequency transceiver circuit operatively connected to an asset tag antenna, the second radio transceiver and asset tag antenna located at the asset tag.

8. The system as set forth in claim 5 wherein the means for comparing the first predetermined identification signal with the predetermined identification code of the asset and the means for synchronizing the asset tag to base station are combined into a first logic controller operating a first software program, the first logic controller located at the asset tag.

9. The system as set forth in claim 5 wherein the means for comparing the second predetermined identification signal with the first predetermined identification signal is a second logic controller operating a second software program, the second logic controller located at the base station.

10. The system as set forth in claim 5 wherein the means for generating the first alarm message comprises further means for manually generating a second alarm message at the asset tag containing further information regarding the asset after the first alarm message has been generated.

11. The system as set forth in claim 10 wherein the means for generating the first and second alarm messages comprise:

a) a first voice-recording circuit for recording the first and second alarm messages;

b) a first message storage memory system for storing the first and second alarm messages;

c) a first message playback circuit for playing the first and second alarm messages from the first message storage memory system;

d) a second alarm message control circuit for activating the first message playback circuit to play the second alarm message when the second alarm message control circuit is manually activated; and e) an audio speaker operatively connected to the first message playback circuit for audibly reproducing the first and second alarm messages.

12. The system as set forth in claim 5 wherein the means for generating a base alarm message comprises an integrated circuit operatively connected to an audio amplifier operatively connected to an audio speaker, the electronic circuit adapted to produce an audible signal as the base alarm message.

13. The system as set forth in claim 5 wherein the means for generating the base alarm message comprises:

a) a second voice-recording circuit for recording the base alarm message;

b) a second message storage memory system for storing the base alarm message;

c) a second message playback circuit for playing the base alarm message from the second message storage memory system; and d) an audio speaker operatively connected to the second message playback circuit for audibly reproducing the base alarm message.

14. A system for identifying a lost asset, comprising:

a) a base station having i) means for assigning a predetermined identification code unique to the asset, ii) a first wireless radio frequency signal transceiver operatively connected to a base station antenna, iii) a first microprocessor operating a first software program operatively connected to the first wireless radio frequency signal transceiver and the means for assigning the predetermined identification code unique to the asset, iv) a base alarm message playback mechanism operatively connected to the first microprocessor, v) a power supply operatively connected to the first transceiver, the first microprocessor and the base alarm message playback mechanism, and vi) a suitable enclosure for housing the elements of the base station listed above whereby the base station is capable of transmitting a first predetermined identification signal unique to the asset, receiving a second predetermined identification signal containing a predetermined identification code of an asset, comparing the first predetermined identification signal with the predetermined identification code contained in the second predetermined identification signal and generating a base alarm message if said predetermined identification code does not match the first predetermined identification signal or if the second predetermined identification signal is not received within a first predetermined period of time; and b) an asset tag having i) means for assigning a predetermined identification code unique to the asset tag, ii) a second wireless radio frequency signal transceiver operatively connected to an asset tag antenna, iii) a second microprocessor operating a second software program operatively connected to the second wireless radio frequency signal transceiver and the means for assigning the predetermined identification code of the asset tag, iv) an asset tag alarm message recording and playback mechanism operatively connected to the second microprocessor, the alarm recording and playback mechanism adapted to record and playback a first alarm message, v) a power supply operatively connected to the second transceiver, the second microprocessor and the alarm message recording and playback mechanism, and vi) a suitable enclosure for housing the elements of the asset tag listed above and attaching to an asset whereby the asset tag is capable of receiving the first predetermined identification signal, comparing the first predetermined identification signal with the predetermined identification code of the asset tag, synchronizing with the base station by transmitting the second predetermined identification signal containing the predetermined identification code of the asset tag if the first predetermined identification signal matches the predetermined identification code of the asset tag and generating the first alarm message if the first predetermined identification signal does not match the predetermined identification code of the asset tag or if the first predetermined identification signal is not received within a second predetermined period of time.

15. The system as set forth in claim 14 wherein the means for assigning a predetermined identification code is programmed into the software program or is manually set through user-selectable devices.

16. The system as set forth in claim 14 wherein the first and second wireless radio frequency transceivers are adapted to communicate over a terrestrial radio link or over a satellite radio link.

17. The system as set forth in claim 14 wherein the base alarm message playback mechanism is an integrated circuit operatively connected to an audio amplifier operatively connected to an audio speaker.

18. The system as set forth in claim 14 wherein the base station power supply includes at least one direct current battery or an AC/DC power adapter.

19. The system as set forth in claim 14 wherein the asset tag alarm message recording and playback mechanism is an integrated circuit operatively connected to a memory storage system, the integrated circuit operatively connected to an audio amplifier operatively connected to an audio speaker.

20. The system as set forth in claim 19 wherein the asset tag alarm message recording and playback mechanism is operatively connected to a second alarm message control circuit, the asset tag alarm message recording and playback mechanism adapted to record a second alarm message, the asset tag alarm message recording and playback adapted to playback the second alarm message after the first alarm message has been generated and after the second message control circuit has been manually activated.

21. The system as set forth in claim 14 wherein the asset tag power supply includes at least one direct current battery.

* * * * *